US007556720B2

(12) United States Patent
Cassina

(10) Patent No.: US 7,556,720 B2
(45) Date of Patent: Jul. 7, 2009

(54) ELECTROSTATIC CHARGE-FREE CONTAINER AND METHOD OF MANUFACTURING SUCH A CONTAINER

(75) Inventor: Virginio Cassina, Gorle (IT)

(73) Assignee: Daviplast-Servicos de Consultoria, Sociedade Unipessoal Lda., Madeira (PT)

( * ) Notice: Subject to any disclaimer, the term of this patent is extended or adjusted under 35 U.S.C. 154(b) by 211 days.

(21) Appl. No.: 11/476,506

(22) Filed: Jun. 28, 2006

(65) Prior Publication Data

US 2006/0272978 A1 Dec. 7, 2006

Related U.S. Application Data

(62) Division of application No. 10/387,740, filed on Mar. 13, 2003, now Pat. No. 7,159,718.

(30) Foreign Application Priority Data

Mar. 14, 2002 (EP) ..... 02425153

(51) Int. Cl.

| | |
|---|---|
| ***C23C 16/00*** | (2006.01) |
| ***B65D 85/84*** | (2006.01) |
| ***B05D 7/22*** | (2006.01) |
| ***B05D 3/00*** | (2006.01) |

(52) U.S. Cl. ..... 204/192.14; 427/181; 427/191; 204/192.1; 118/723 VE; 220/372; 220/200; 206/524.1; 215/261

(58) Field of Classification Search ..... 427/428.1, 427/181, 191; 118/723 VE; 220/372, 200; 204/192.1; 206/524.1; 215/261
See application file for complete search history.

(56) References Cited

U.S. PATENT DOCUMENTS

| | | | | |
|---|---|---|---|---|
| 4,337,279 | A * | 6/1982 | Polak | 427/537 |
| 4,909,387 | A | 3/1990 | Schutz | |

(Continued)

FOREIGN PATENT DOCUMENTS

| | | |
|---|---|---|
| DE | 1 028 408 | 4/1958 |
| DE | 41 25 524 A1 | 2/1993 |
| DE | 100 14 240 A1 | 9/2001 |
| DE | 201 18 731 U1 | 3/2002 |
| EP | 0 674 470 A1 | 2/1995 |

(Continued)

OTHER PUBLICATIONS

EP Search Report Sep. 17, 2002.

(Continued)

*Primary Examiner*—Timothy H Meeks
*Assistant Examiner*—Mandy C. Louie
(74) *Attorney, Agent, or Firm*—Kalow & Springut LLP

(57) ABSTRACT

Container for the storage and/or transportation of liquids or powders, in particular inflammables, suitable for preventing the formation of electrostatic charge, comprising a tank supported by a pallet, housed in a metallic cage and having an outer surface in contact with said metallic cage. The tank comprises a base layer of plastic material, a layer modified through plasma and a layer of metallic material deposited with vacuum PVD (Physical Vapor Deposition )technique. The metallic layer is in contact with the cage. The metallization of a plastic tank is carried out by generating in a chamber a plasma which activates the outer surface of said tank so as to form a surface layer and carrying out, with vacuum PVD technique, the deposition of a layer of conductive metallic material superposing said surface layer to obtain a tank metallized on the outside.

14 Claims, 2 Drawing Sheets

U.S. PATENT DOCUMENTS

| | | | | |
|---|---|---|---|---|
| 4,947,988 | A | 8/1990 | Schutz | |
| 5,353,949 | A * | 10/1994 | Seibert et al. | 220/371 |
| 5,552,226 | A * | 9/1996 | Thurm et al. | 428/412 |
| 5,634,561 | A | 6/1997 | Pfeiffer | |
| 5,704,476 | A | 1/1998 | Abbott | |
| 6,050,437 | A | 4/2000 | Schutz | |
| 6,156,969 | A | 12/2000 | Schutz | |
| 6,223,683 | B1 * | 5/2001 | Plester et al. | 118/723 VE |
| 6,419,104 | B1 * | 7/2002 | Sarajian | 220/234 |
| 2003/0196923 | A1 | 10/2003 | Decroix | |
| 2003/0230580 | A1 | 12/2003 | Schutz | |

FOREIGN PATENT DOCUMENTS

| | | | |
|---|---|---|---|
| EP | 0 647 089 | | 4/1995 |
| EP | 0 674 470 | B1 | 8/1997 |
| EP | 0 674 470 | B2 | 7/2004 |
| JP | 10058586 | | 3/2001 |
| WO | WO 0155475 | A | 8/2001 |
| WO | WO 01/86225 | A1 | 11/2001 |

OTHER PUBLICATIONS

EP Search Report Dec. 13, 2002.
EP Search Report Feb. 24, 2004.
Notice of Opposition filed by Protechna EP Patent No. 1 354 815.
Italian translation of Grounds EP Patent No. 1 354 815.

* cited by examiner

ELECTROSTATIC CHARGE-FREE CONTAINER AND METHOD OF MANUFACTURING SUCH A CONTAINER

This application is a divisional application of U.S. Ser. No. 10/387,740, filed Mar. 13, 2003, the entire disclosure of this application is hereby incorporated by reference.

BACKGROUND OF THE INVENTION

1. Field of the Invention

The present invention refers to a container capable of preventing the formation of electrostatic charge, intended for the storage and/or transportation of liquids or powders, in particular inflammables, and also, but not exclusively capable of being used in environments with a high risk of explosion.

In particular, the invention regards a container for the storage and/or transportation of liquids or powders, in particular inflammables, suitable for preventing the formation of electrostatic charge, comprising a tank externally metallized, supported by a pallet and housed in a metallic cage so as to be in contact with it, as well as the method for carrying out the outer metallization of the tank.

2. Description of the Related Art

As is known, the presence of an outer conductive surface layer allows the rapid draining, towards a means connected to ground, of the possible static electricity which accumulates on the outer surface of the tank, for example during the moving of the container, the filling/emptying of the tank or in other circumstances in which any sort of friction is produced on the surface. Moreover, it is necessary to foresee the possibility of using the tank in areas where there is a risk of explosion, for example chemical firms or areas intended for varnishing, where substances which can detonate are used and manipulated, even if the material inside the tank is not per se explosive.

In industry, plastic tanks are now widely used for storing and transporting liquid, powdered, granular and volatile products.

With respect to metallic tanks, plastic tanks have countless advantages, such as resistance to corrosion, ability to recover its original shape if subjected to deformations and thermal insulation.

To transport liquids plastic tanks are commonly used, commonly referred to as IBCs (Intermediate Bulk Containers) with capacities of between 450 and 3000 liters.

Such tanks are housed inside metallic cages supported by pallets consisting of simple wood, of plastic or of metal.

Whereas the tank carries out the task of containing the liquid, the metallic cage guarantees the necessary structural resistance, preserving the integrity of the tank in case of stresses due to knocks, falling and vibrations of the container.

In this way the container satisfies safety requirements both during warehouse storage, and during movement and transportation.

The problem is more complex in the case in which such containers are intended to contain and transport materials, in particular materials which are flammable and/or which have a high risk of explosion, and are moved, filled or emptied in explosion risk areas classified under R044-001 in the CENELEC Report (February 1999) Comité Européen de Normalisation Electrotechnique, Brussels.

In particular, amongst the flammable substances which plastic IBCs can contain it is necessary to consider those with an average and high flammability point, for example 3.2 and 3.3 according to RID ADR IMO.

Indeed, it is known that plastic tanks, for example made of high density polyethylene (HDPE), are, like all electrically insulated bodies, subjected to the accumulation of surface electrical charge by triboelectric effect during their handling, the loading and unloading of the material from the tank or by simple exposure to relatively dry air flows.

The electrical charge, or static electricity thus accumulated in turn generates around the tank an electric field the intensity of which can reach values so high, even only locally, by effect of the geometric shape of the tank or of surrounding elements (which in turn can be already charged or charged up by electrical induction/polarization), as to exceed the insulating strength of the environment (air or supports) surrounding the containers.

This can determine the growing up of electrical arcs, with the consequent risk of ignition of the vapors given off by the tanks, of the substances contained in them or of the vapors previously present in the external environment for example in the case of explosion risk areas.

Against the aforementioned advantages the plastic material which the tank is made of, which determines its electrical insulation, is the main cause of the formation of electrostatic discharges or electric arcs.

It is therefore necessary to prevent the accumulation of electrical charge on the surface of containers and, more specifically, of tanks providing them with suitable provisions which allow its easy dispersion to ground.

In the case of entirely metallic containers or tanks this is obtained by simply providing suitable ground connections for them.

Nevertheless, nowadays, the most widely used containers are those which comprise a plastic tank not just because they are more cost-effective and handy but also for a better and wider-ranging compatibility with the substances which they have to contain.

For this kind of electrically insulated containers there is a strong need to prevent the formation of electrostatic charge, for example through coating of the outer surface of the tank with a conductive material, fully adherent or even just in contact, which can be connected to a ground.

The coating can be continuous or discontinuous, with more or less compact meshes, provided that they are such as to ensure a low surface resistivity.

Amongst the most recent tendencies of technology there is that of directly forming, on the outer surface of the containers, a highly conductive layer.

Various methods are known in the state of the art for forming conductive layers on the surface of containers intended for the storage and transportation of dangerous and flammable materials and for the handling of the containers themselves in high explosion risk areas.

As a replacement for the coating with conductive varnishes, which has the drawback of not ensuring a sufficiently low resistivity, and of being very degradable and flaky in time, it has been proposed in document EP 674,470 to form a conductive layer sintering metallic powders on the surface of a plastic tank.

By sintering, in brief we mean a process in which a metallic powder, specifically zinc and/or copper, is sprayed on the surface of the container and at the same time the surface is heated or treated by a flame, so that the surface melts and incorporates the metallic powder. Varnishing and galvanic plating methods of plastic materials also exist.

The aforementioned methods have the drawback of not providing a uniformly conductive surface, of requiring a substantial waste of electrical energy necessary for the operation of the heat generating devices, of producing a large amount of harmful waste which needs to be disposed of and hence structures and equipments suitable for such a purpose with a consequent increase in costs for the industry.

It must be highlighted that the thickness of the conductive layer obtained with known techniques is in the order of millimeters and allows only a slight electrical conductivity to be obtained.

SUMMARY OF THE INVENTION

The problem forming the basis of the present invention is that of providing a container intended for the storage and/or transportation of liquids or powders, in particular inflammables, also, but not exclusively, capable of being used in high explosion risk environments, suitable for preventing the formation of electrostatic charge, so as to satisfy the aforementioned requirement, and having structural and functional characteristics such as to avoid the aforementioned drawbacks with reference to the prior art.

Such a problem is solved by a container comprising a tank supported by a pallet, housed in a metallic cage and having an outer surface in contact with the metallic cage. The tank comprises a base layer of plastic material comprising on the outside a surface layer modified through plasma treatment in order to improve the wettability on surface of the base layer and a layer of metallic material associated in superposition with the surface layer through deposition with vacuum PVD (Physical Vapor Deposition) technique. The layer of metallic material is in contact with the metallic cage to make equipotential the cage and the outer surface of the tank.

According to another aspect of the present invention, there is provided a method for the metallization of a plastic tank with at least one opening, comprising the steps of preparing a chamber for vacuum processes, introducing the plastic tank into the chamber, creating a pre-vacuum in the chamber, subjecting the gas inside the chamber to an electric field such as to generate a plasma suitable for forming, on the outer surface of the tank, a modified surface layer with an improved wettability, creating a high-vacuum in the chamber, carrying out, with vacuum PVD (Physical Vapor Deposition) technique, the deposition of a layer of conductive metallic material superposing the surface layer of the tank to obtain a tank metallized on the outside, and re-establishing atmospheric pressure in the chamber.

According to still another aspect of the present invention, there is provided a method for the metallization of a plastic pallet, comprising the steps of preparing a chamber for vacuum processes, introducing the plastic pallet into the chamber, creating a pre-vacuum in the chamber, subjecting the gas inside the chamber to an electric field such as to generate a plasma suitable for forming, on the outer surface of the pallet, a modified surface layer with an improved wettability, creating a high-vacuum in the chamber, carrying out, with vacuum PVD (Physical Vapor Deposition) technique, the deposition of a layer of conductive metallic material superposing the surface layer of the pallet to obtain a pallet metallized on the outside, and re-establishing atmospheric pressure in the chamber.

In particular, the container according to the invention comprises a plastic tank, preferably made of HDPE (high density polyethylene), with the outer surface modified through plasma treatment to improve its wettability and coated with a layer of metallic material deposited through vacuum PVD (Physical Vapor Deposition) techniques.

The tank is made of plastic material, advantageously but not necessarily, of high density polyethylene (HDPE).

With the term polyethylene, used in the present description, we mean to indicate both pure polyethylene, and mixtures of polymers which include polyethylene or polyethylene together with other substances, for example fillers or reinforcing agents.

Preferably, the container according to the invention comprises means for creating an effective protection against electrostatic discharges through a continuous electric path between the metallic layer, the metallic cage, the pallet and a ground.

Advantageously, the method for the metallization of the plastic tank is carried out with vacuum PVD techniques which have the advantage of producing no waste and generating no by-products, since all of the production steps are carried out dry.

Vacuum PVD deposition techniques constitute a valid and effective solution for the definitive replacement of the galvanic plating process on plastic which is highly polluting and dangerous for human health.

The plastic tank metallized through vacuum PVD techniques has better characteristics in terms of surface hardness, chemical stability and resistance to corrosion with respect to the metallization obtained according to the methods described with reference to the prior art.

The production steps according to the method of the present invention are performed in a particular kind of gaseous environment, defined as plasma, the function of which shall become clearer from the rest of the description.

Plasma is a partially ionized gas characterized by the simultaneous presence of neutral molecules, positive ions and free electrons in sufficient quantities to obtain a substantial electrical conductivity.

The cold plasma used in the method according to the invention is obtained by applying an electric field of an intensity such as to ionize the residual gas in an environment in which a vacuum condition or, in an equivalent manner, a pressure lower than atmospheric pressure has previously been created.

This condition allows the performance in a temperature range of 30 to 80° C. of reactions which at atmospheric pressure are only possible at temperatures comparable with the plastic deformation/softening temperatures of the plastic material, if not greater.

This is due to the fact that the very low pressure inside the chamber and consequently the reduced convectivity, allow heat sources to be used to make the metals vaporize even in the order of 1000-1500° C. without damaging the tank.

Before metallization, the outer surface of the tank is treated to increase the adhesion of the subsequent conductive layer. Substantially, the polymer of the plastic material of the tank is bombarded with electrons and negative ions of inert gases (for example Argon, Nitrogen) or reactive gases (for example Oxygen, Nitrogen Oxide, various fluorinated and chlorinated components as well as plain air) in order to activate it, making it available for the subsequent vacuum metallization step. The vapor deposition processes by physical phenomenon (PVD) are defined as atomic, since the material to be deposited, in the form of atomic particles obtained by vaporization from a solid (sublimation process) or liquid (evaporation process) source, is transported through the plasma.

The vacuum condition ensures that the mean free path of the particles present in it increases to such a point as to allow the particles themselves to reach the surface of the plastic material of the tank without them being subjected to collisions.

This particular environmental condition allows the particles to reach the surface of the plastic tank with an energy such as to modify the chemical-physical characteristics of the material and, in the subsequent metallization step, to deposit the metallic material uniformly on the previously modified surface.

When the vapor of the material to be deposited mixed with the plasma is in contact with the part to be treated, it condenses covering all of the surface uniformly.

The material to be deposited can be an element, (for example Al, Ag, Cr), a compound (for example $SiO_2$) or an alloy, for example stainless steel.

Two PVD processes are taken into consideration in this invention, to be precise: vacuum thermal evaporation and PVD sputtering.

Vacuum thermal evaporation, which includes sublimation, is a PVD process in which the material to be deposited, conveniently heated, is vaporized in a high-vacuum environment, allowing its uniform condensation on the surface of the tank to be metallized.

PVD sputtering is a process of deposition of particles extracted from an electrode by a non-thermal process.

In this case the surface atoms of an electrode formed of the material to be deposited are extracted by transfer of momentum from energetic particles, usually ions accelerated by effect of an electric field in a plasma, which strike or bombard the surface of the electrode.

It is worthwhile noting that with the vacuum thermal evaporation, process chambers larger in size with respect to the PVD sputtering technique are indispensable since, for the reasons explained previously, it is necessary to keep a substantial distance between the plastic material of the tank and the heat source.

PVD sputtering offers the advantage of being able to deposit not only elements and compounds but also alloys, an operation which it is not possible to carry out with vacuum thermal evaporation since there would be the separation of the different components which form the alloy for temperatures over the eutectic temperature.

With respect to vacuum thermal evaporation, PVD sputtering is a slower deposition process but it offers a better quality from the point of view of the uniformity of the deposited layer and allows the deposition of alloys such as stainless steel, so as to obtain a metallized layer with an excellent resistance to scratching and with excellent characteristics of electrical conductivity.

The thickness of the metallized layer obtained by means of PVD techniques is, moreover, so small (values of less than a micron) that the metallized tank keeps the characteristics of elasticity of the plastic material which it is formed of, ensuring at the same time the requested electrical conductivity.

Indeed, from tests carried out on the end product it has been noted that even a metallic layer having a thickness of less than a micron is easily sufficient to guarantee the surface conductivity necessary for a rapid grounding of electrical charge.

It should be noted that the lower amount of metallic material consumed in deposition with PVD techniques allows a substantial saving to be made in terms of the raw materials used, with a clear economic advantage. Moreover, this allows noble metals, such as silver or even gold, with high electrical conductivity and resistance to passivation to be used.

Lastly, the deposition rate of the metallic material can easily be determined and controlled, from which derives the advantage of being able to define with the maximum precision the final thickness of the metallized layer.

BRIEF DESCRIPTION OF THE DRAWINGS

The characteristics and further advantages of the invention shall become clearer from the following description of a preferred embodiment, given in a not limiting manner with reference to the attached drawings in which.

DESCRIPTION OF THE PREFERRED EMBODIMENT

With reference to the attached figures, with C is generically indicated a container according to the invention for transporting substances, in this specific case a liquid, intended also to be used in high explosion risk environments.

The container C comprises a tank 1 housed in a metallic cage 2 and supported by a pallet 3, in the example a standard sized pallet.

The tank 1 is a parallelepiped square with rounded corners and is made of plastic material through the usual extrusion-blowing or rotoforming methods and is then metallized with the method of the present invention according to claim 8.

The extruded-blown or rotoformed material can, in a preferred embodiment, be high density polyethylene (HDPE) which has the same chemical-physical characteristics as polyethylene but with a greater strength of the final structure of the tank.

Figure 1:
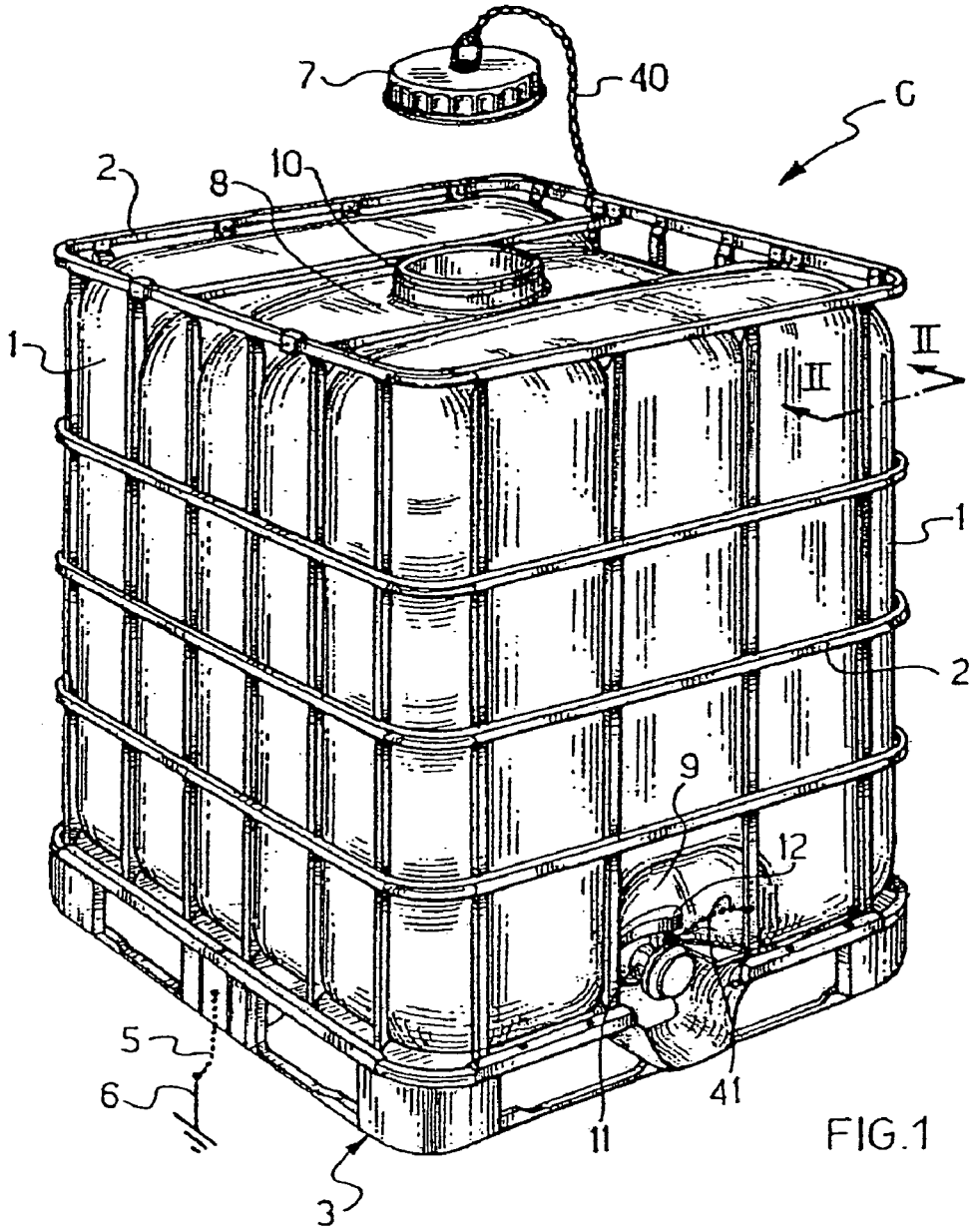
FIG. 1 represents a schematic view of a container according to the present invention comprising a vacuum metallized tank.

The pallet 3 can be made of metallic material or insulating material, for example wood or plastic. In the example of FIG. 1, the pallet 3 is made of metallic material.

In the case in which the pallet 3 is also made of plastic material, said pallet can be metallized in a vacuum with the same metallization method with which the metallization of a plastic tank 50 is described hereafter.

For the grounding of the pallet 3, or of a metallized plastic pallet, a plaited conductor stranded 5 for connection between the pallet 3 and a ground 6 is supplied, since the electrical connection between the pallet 3 and the metallic cage 2 is guaranteed by the mechanical contact.

In the case in which the pallet is made of wood it is necessary to provide a plaited conductor for the electrical connection of the metallic cage with a ground.

During transportation the ground 6 can be replaced by the metallic structure of the mechanical equipment which transports the container or by other means which are in any case connected to ground.

The tank 1 is provided with openings for loading 8 and unloading 9 the material, each equipped with respective threaded pipe unions 10 and 11.

On the loading pipe union 10 an internally threaded cap 7 is screwed, which, in the case it is made of plastic material, advantageously can by metallized on the outside by the methods of the present invention or by others. In the example of FIG. 1, the cap 7 is made of metallic material.

On the unloading pipe union 11 a discharge valve 12 is screwed, through which it is possible to control the outflow of the liquid from the tank 1.

The connection between the metallic cage 2 and the loading cap 7 can be realized through a metallic chain 40.

This allows the possible static electricity accumulated on the cap 7 to be grounded and allows the loading operation to be eased, exonerating the user from any action to be carried out on the cap which is not the screwing/unscrewing operation.

The unloading valve 12 can be made of metallic material or of insulating material, for example plastic. In the example of FIG. 1, the valve 12 is made of metallic material.

In the case in which the valve 12 is made of plastic material, it can advantageously be metallized in a vacuum with the same metallization method which the tank 50 is metallized with.

For the electrical connection between the metallic cage 2 and the unloading valve 12 it is possible in the same way to use a chain or a plaited conductor 41.

From the unloading valve 12, from the loading cap 7 and from the tank 1, through the metallic cage 2, a continuous electrical path towards the ground 6 is created.

The plaited conductor 5 can be replaced by conductive rods, chains or the like.

The metallic cage 2 is fixed to the pallet 3 with suitable means, not represented in the figures, for example by U-shaped bent sheet metal strips extending around the peripheral segment of the metallic cage and fixed to the pallet by means of bolts or the like.

Figure 2:
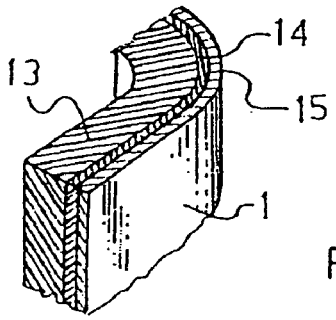
FIG. 2 represents a section view of a portion of the wall of the metallized tank of FIG. 1.

With reference to FIG. 2, the wall of the tank 1 seen in a section view has a base layer 13 of plastic material the outer surface of which, that is the surface of the layer facing towards the outside of the tank, has been modified through plasma treatment so as to define a surface layer 14 clean and excited in order to have a better wettability and a better adhesion of the actual metallic layer.

Furthermore, the wall of the tank 1 comprises a layer 15 of metallic material associated in superposition with the aforementioned surface layer 14 through deposition with a vacuum PVD (Physical Vapor Deposition) technique.

Advantageously, the layer 15 of metallic material is arranged in contact with the metallic cage 2, so that all of the outer surface of the tank 1 is necessarily equipotential with the cage 2.

Figure 3:
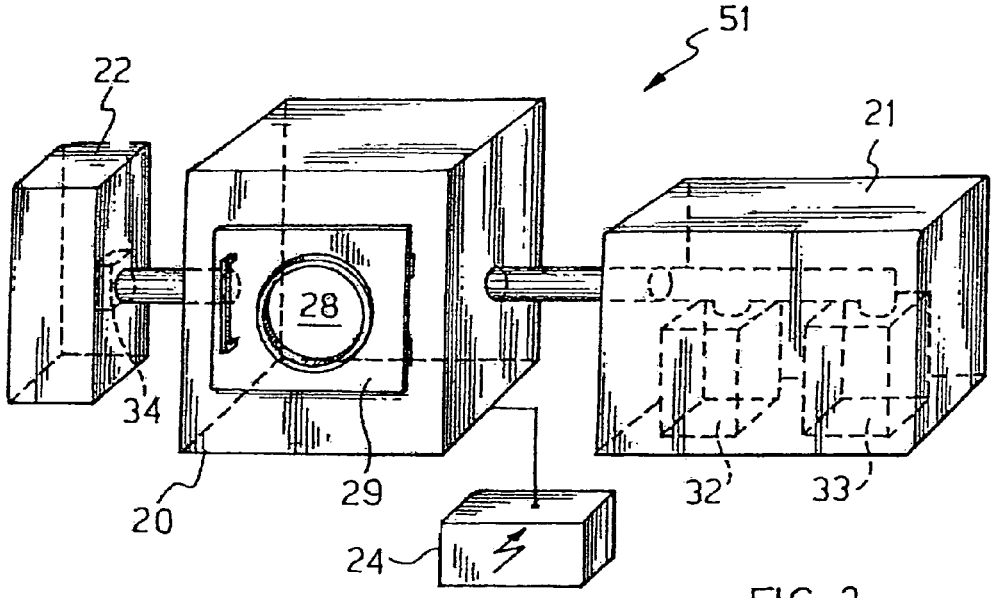
FIG. 3 represents a schematic view of an apparatus for treating the surface of a plastic tank in order to obtain the tank of FIG. 1.
Figure 4:
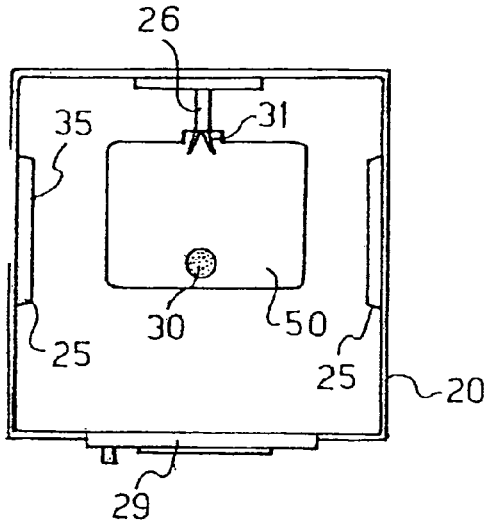
FIG. 4 represents a schematic section view of a detail of the apparatus of FIG. 3.
Figure 5:
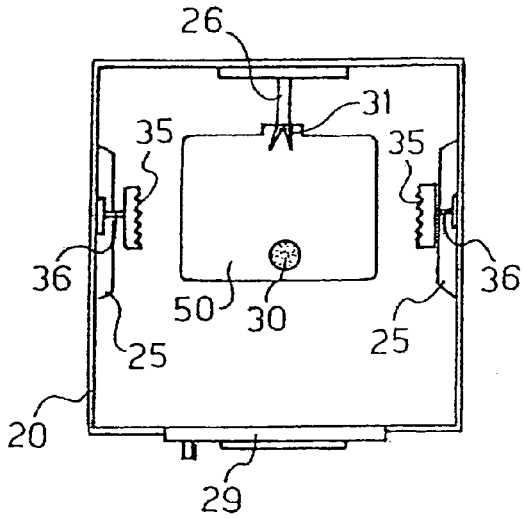
FIG. 5 represents a schematic section view of a detail of the apparatus of FIG. 3 in accordance with a different embodiment.

With particular reference to FIGS. 3 to 5, the method for treating a plastic tank 50, in order to obtain the metallized tank 1 described previously, is described hereafter. Such a method is carried out through an apparatus generically indicated with 51.

As can be seen from FIG. 3, the apparatus 51 in its essential parts comprises:

a chamber for vacuum processes 20, a pumping group 21 to evacuate the air from the chamber 20, a system 22 for supplying and controlling the gas flow, an electrical power supply system 24 for electrodes 25 placed in the chamber 20 (FIG. 4).

The chamber 20 is provided with a window 28 for the visual control of the plasma and of the step of evaporation of the metal and it is controlled, in the testing phase, with a helium mass spectrometer to guarantee its perfect seal and airtightness in conditions of vacuum lower than the real working conditions.

The chamber 20 is provided with an opening which allows complete access to the inside of the chamber 20 and with which a sealing door 29 is associated to close it.

With reference to FIG. 4 the chamber 20 comprises:

one or more electrodes, in the example two in number and indicated with 25, a pick-up and moving group 26 comprising pliers 31 for picking up the tank 1 to be metallized and actuation means for moving the pliers 31 inside the chamber 20.

Inside the chamber 20 a process zone is defined which includes the electrodes 25 suitable for generating a sufficient electric field to sustain the plasma.

The electrodes 25, or cathodes, are arranged inside the chamber 20 so as to adhere to the walls. The electrodes 25, are essentially metallic plates, preferably made of stainless steel, aluminum or titanium, to which a DC (Direct Current) or else RF (Radio Frequency), for example a frequency of 13.56 MHz or 2.45 GHz, electric power supply is applied through the power supply 24 (FIG. 3).

The metallization of the outer surface of the tank 50 is carried out in the chamber 20 by performing the steps listed hereafter.

In a first step the plastic tank 1 is placed in the chamber 20 so as to be held and supported by the pliers 31 inserted into the loading pipe union 10, provided the unloading pipe union 11 is closed with means suitable for allowing the passage of gas, in the example air, and not of metallic molecules.

In the example, the aforementioned means comprise a membrane 30 the characteristics of which are such as to allow the passage of air and to prevent the entry of metal vapors inside the tank 50. This is obtained, for example and not for limiting purposes, with many diaphragms with non-aligned perforations such as to form a labyrinth.

The passage of air is essential in the step of evacuation of the air inside the chamber 20 and thus of that which is inside the tank 1.

It is also important to prevent the entry into the tank 50 of the metal particles during the metallization step.

Indeed, such particles, depositing inside the tank attaching to its walls, would then be dangerously in contact with the product, for example an acid, to the transport of which the tank may be intended to be transported in the tank.

Alternatively, the pliers 31 can be inserted into the unloading pipe union 11, provided that the loading pipe union 10 is closed through a membrane.

The metallization process consists of:

a first step of plasma pretreatment of the tank 50, having the task of cleaning and modifying/activating (etching) a surface layer 14 of the base layer 13 of which the tank 50 consists and a second deposition step through deposition with a vacuum PVD technique of a layer 15 of metallic material on the modified/activated surface layer 14.

To carry out the metallization process it is necessary to insert the tank 50 into the chamber 20 and fasten it through the loading pipe union 10 to the pliers 31.

After having closed the sealing door 29, the mechanical rotative pumps 32 of the pumping group 21 are actuated until a prevacuum lower than a value in the order of $10^{-1}$ mbar is produced.

The mechanical rotative pumps 32 have a suction capability such as to produce a pressure inside the chamber of a value between $10^{-1}$ and $10^{-2}$ mbar, in a variable timespace according to the size of the chamber 20, as an indication in a timespace of 2-3 minutes.

The system 22 for supplying and controlling the gas flow is necessary to set the pressure value inside the chamber 20 in an automatic and precise manner, providing a gas flow entering into the chamber, in particular to restore atmospheric pressure at the end of the process, for example through needle valves 34, which can be replaced with equivalent vacuum sealing valves.

The electrodes 25 electrically excite the residual gas contained in the chamber 20, even added through the system 22, partially ionizing it and sustaining the plasma.

Then to the cathodes 25 a DC or RF power is applied suitable for supplying the plasma, in the aforementioned pressure conditions, with sufficient energy to modify the chemical-physical characteristics of the outer surface of the base layer 13, breaking the carbon bond of the polymer which it is made of.

As a consequence of this, the wettability of the outer surface of the base layer 13 is improved, that is a modified, cleaned and excited surface layer 14 is provided for a better adhesion of the metal particles.

The result of the plasma treatment is thus the formation of new functional groups on the outer surface of the base layer 13 of the tank 50.

Since the energy of the plasma is not sufficient to penetrate deeply into the base layer 13, only the most outer molecular layers of it are modified, by this way producing the surface layer 14. The properties of the remaining part of the base layer 13 remain unchanged.

Preferably, during the step of activation of the base layer 13 of the tank 50, the pick-up and moving group 26 takes care of the moving of the pliers 31 with respect to the chamber 20. This determines a corresponding moving of the tank 50, with an improvement in the uniformity of the activated/excited surface layer 14 building up.

As the size and working pressure of the chamber 20 and the arrangement of the electrodes 25 changes, the DC or RF power necessary for the plasma treatment step changes.

The base layer 13 excitement operation, with the formation of a surface layer 14, is, moreover, used to clean the outer surface of the base layer 13 from possible organic impurities which could reduce the efficiency of the metallization process and the adhesion of the layer of metallic material 15.

The aforementioned surface layer 14, on which the metal vapor is then deposited, must be understood as an intermediate layer with characteristics different from those of the plastic material of which the tank 50 consists.

After the plasma cleaning and etching step is completed, the plasma is shut off interrupting the supply to the electrodes 25 and one proceeds with the metallization process.

Firstly, the diffusion pumps 33 are actuated which produce a high-vacuum lower than or in the order of $10^{-3}$ mbar, preferably in the order of $10^{-5}$ mbar.

The diffusion pumps 33 have a suction capability such as to produce, in a variable timespace according to the size of the chamber 20, a pressure inside the chamber 20 of a value between $10^{-3}$ and $10^{-7}$ mbar.

Once the optimal pressure value is reached inside the chamber 20, even acting on the valve 34 to increase the pressure in the case the pressure in the chamber 20 is too low, the electrodes 25 are reactivated so as to determine a new environmental condition of plasma inside the chamber 20.

Preferably, during the step of metallization of the tank 50, the pick-up and moving group 26 takes care of moving the pincers 31 with respect to the chamber 20. This determines a corresponding movement of the tank 50, with an improvement in the uniformity of the layer of metallic material 15 building up.

The chamber 20 illustrated in FIG. 4 is particularly recommended for deposition with the PVD sputtering technique (cathodic pulverization) through which it is possible to deposit any material, element, compound or alloy.

In the example, the PVD sputtering source is realized in the electrodes 25 intended to sustain the plasma. Nevertheless, it is possible to provide distinct electrodes specifically intended for the treatment of the base layer 13 and for the subsequent metallization.

The pressure value lower than the one used to carry out the etching determines the formation of a more energetic plasma, capable of extracting the metal particles from the PVD sputtering source.

PVD sputtering, as stated previously, is particularly recommended for the deposition of stainless steel and chrome layers.

The high-vacuum inside the chamber 20 and the plasma treatment described previously, which the base layer 13 is subjected to before the vacuum metallization step, ensure a uniform distribution and a perfect adhesion to the surface 14 of the metal particles extracted from the PVD sputtering source with the formation of the layer of metallic material 15.

FIG. 5 refers to a different embodiment of the chamber 20, suitable for being used in the case of PVD deposition technique by high-vacuum thermal evaporation.

In this case once the plasma cleaning and etching step is completed, the plasma is stopped and not reactivated again and one proceeds with the metallization process.

The chamber 20 comprises a heat source, indicated with 36, upon which the metal 35 to be vaporized is arranged.

Advantageously, the source 36 is a tungsten filament, that is the metal with the highest melting point, to be precise 3283° K at atmospheric pressure.

Alternatively, the tungsten filament can be replaced by another element with a different form, for example a spiral, realized with a different material provided that it is capable of heating without melting to a sufficient temperature to vaporize the metal 35 arranged on it.

The vaporization process considered above is also defined as sublimation, that is the immediate passage from solid state to gas state.

The metal 35 vaporized by the heat source 36, transformed into metal particles, spreads uniformly in the vacuum, depositing by condensation on the highly receptive surface layer 14.

For both the vacuum thermal evaporation and PVD sputtering processes, at the end of the metallization treatment, in the chamber 20, air is injected, through the system 22 comprising the valves 34, to re-establish atmospheric pressure, to cool the surface of the tank 1 and to allow the door 29 to be opened, to proceed to the extraction of the metallized tank 1.

The deposited metallic layer has a thickness of between 0.01 μm and 3 μm, preferably 0.1 μm, sufficient to avoid the formation of electrostatic charge, provided that a continuous electrical path is available to ground.

Without affecting the fact that what is stated above is a complete description of the preferred embodiment of the invention, many variants, modifications and equivalents can be proposed by the man skilled in the art.

The previous description must therefore be understood to be illustrative, but not limiting, of the purpose of the invention.

The invention claimed is:

1. Method for the metallization of a plastic tank with at least one opening, comprising the steps of:

preparing a chamber for vacuum processes;

introducing said plastic tank into said chamber, the plastic tank being provided with a loading pipe union and an unloading pipe union;

creating a pre-vacuum in said chamber;

subjecting the gas inside said chamber to an electric field such that it generates a plasma suitable for forming, on the outer surface of said tank, a modified surface layer with an improved wettability;

creating a high-vacuum in said chamber;

depositing a layer of conductive metallic material superposing said surface layer of the tank to obtain a tank metallized on the outside by using vacuum PVD (physical Vapor Deposition) technique, and re-establishing atmospheric pressure in said chamber, wherein at least one of the pipe unions is closed through means suitable for allowing the passage of gas and for preventing the passage of metallic molecules during the step of depositing a layer of conductive metallic material.

2. Method according to claim 1, wherein said vacuum PVD technique comprises vacuum thermal evaporation.

3. Method according to claim 2, wherein said conductive metallic materials are selected from the group consisting of Al, Ag, Cr, and Au.

4. Method according to claim 1, wherein said vacuum PVD technique comprises PVD sputtering.

5. Method according to claim 4, wherein said conductive metallic materials are selected from the group consisting of Cu, Zn, Al, Ag, Cr, Au, steel and metallic alloys.

6. Method according to claim 1, wherein the deposited layer has a thickness of between 0.01 μm and 3 μm.

7. Method according to claim 1, wherein said pre-vacuum corresponds to a pressure measured inside said chamber less than or in the order of $10^{-1}$ mbar.

8. Method according to claim 1, wherein said pre-vacuum corresponds to a pressure measured inside said chamber of between $10^{-1}$ mbar and $10^{-2}$ mbar.

9. Method according to claim 1, wherein said high-vacuum corresponds to a pressure measured inside said chamber less than or in the order of $10^{-3}$ mbar.

10. Method according to claim 1, wherein said high-vacuum corresponds to a pressure measured inside said chamber in the order of $10^{-}$mbar.

11. Method according to claim 1, wherein said means suitable for allowing the passage of gas comprise a labyrinth membrane.

12. Method according to claim 1, wherein said tank is moved in the chamber during said step of deposition with vacuum PVD technique.

13. Method according to claim 1, wherein said tank is moved in the chamber during all of the steps of the metallization method of the tank.

14. The method of claim 1, wherein pliers are inserted into either of the loading pipe or the unloading pipe so as to hold the plastic tank and the pipe not provided with pliers is closed through means suitable for allowing the passage of gas and for preventing the passage of metallic molecules during the step of depositing a layer of conductive metallic material.

* * * * *